US007586445B2

(12) United States Patent
Qin et al.

(10) Patent No.: US 7,586,445 B2
(45) Date of Patent: Sep. 8, 2009

(54) MIMO ANTENNA

(75) Inventors: Xiang-Hong Qin, Shenzhen (CN); Jia-Lin Teng, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/934,092

(22) Filed: Nov. 2, 2007

(65) Prior Publication Data

US 2008/0246689 A1 Oct. 9, 2008

(30) Foreign Application Priority Data

Apr. 6, 2007 (CN) ..... 2007 1 0200405

(51) Int. Cl.
*H01Q 1/38* (2006.01)
*H01Q 5/00* (2006.01)
*H01Q 9/04* (2006.01)

(52) U.S. Cl. ..... 343/700 MS; 343/846; 343/895

(58) Field of Classification Search ..... 343/700 MS, 343/846, 895
See application file for complete search history.

(56) References Cited

U.S. PATENT DOCUMENTS 5,949,383 A * 9/1999 Hayes et al. ..... 343/795
6,496,148 B2 * 12/2002 Ngounou Kouam et al. . 343/700 MS
6,961,028 B2 * 11/2005 Joy et al. ..... 343/895
7,405,699 B2 * 7/2008 Qin ..... 343/700 MS
7,411,554 B2 * 8/2008 Jung et al. ..... 343/700 MS
7,439,923 B2 * 10/2008 Quintero Illera et al. .... 343/702
2007/0115181 A1 5/2007 Park et al.

* cited by examiner

*Primary Examiner*—Vibol Tan
*Assistant Examiner*—Jason Crawford
(74) *Attorney, Agent, or Firm*—Frank R. Niranjan

(57) ABSTRACT

A MIMO antenna is disposed on a substrate. The substrate includes a first surface and a second surface. The MIMO antenna includes a first antenna and a second antenna set as mirror image to the first antenna, each of the first and the second antennas includes a radiation body, a feeding portion, and a grounded portion. The radiation portion is disposed on the first surface for transceiving electromagnetic signals. The radiation body includes a first radiation portion and a second radiation portion electronically connected to the first radiation portion. The first radiation portion is serpentine-shaped and the second radiation portion is rectangular-shaped. The feeding portion is disposed on the first surface, and electronically connected to the second radiation portion for feeding electromagnetic signals to the radiation body. The grounded portion is disposed on the second surface.

14 Claims, 7 Drawing Sheets

MIMO ANTENNA

BACKGROUND OF THE INVENTION

1. Field of the Invention

The present invention relates to wireless communication, and particularly to a Multi Input Multi Output antenna.

2. Description of Related Art

Recently, the Multi Input Multi Output (MIMO) technology has achieved significant growth due to the ever growing demand for wireless communication products. MIMO antennas are widely used in the field of wireless communication. Generally, a MIMO antenna includes at least two individual antennas. Each antenna should be designed as small as possible and the isolation between the antennas should be designed to satisfy space and radiation requirements of wireless local area network (WLAN) devices employing the antennas.

SUMMARY OF THE INVENTION

One aspect of the present invention provides a Multi Input Multi Output (MIMO) antenna. The MIMO antenna is disposed on a substrate. The substrate includes a first surface and a second surface. The MIMO antenna includes a first antenna and a second antenna set as mirror image to the first antenna, each of the first and the second antennas includes a radiation body, a feeding portion, and a grounded portion. The radiation portion is disposed on the first surface for transceiving electromagnetic signals. The radiation body includes a first radiation portion and a second radiation portion electronically connected to the first radiation portion. The first radiation portion is serpentine-shaped and the second radiation portion is rectangular-shaped. The feeding portion is disposed on the first surface, and electronically connected to the second radiation portion for feeding electromagnetic signals to the radiation body. The grounded portion is disposed on the second surface.

Other objectives, advantages and novel features of the present invention will be drawn from the following detailed description of preferred embodiments of the present invention with the attached drawings, in which:

DETAILED DESCRIPTION OF THE INVENTION

Figure 1:
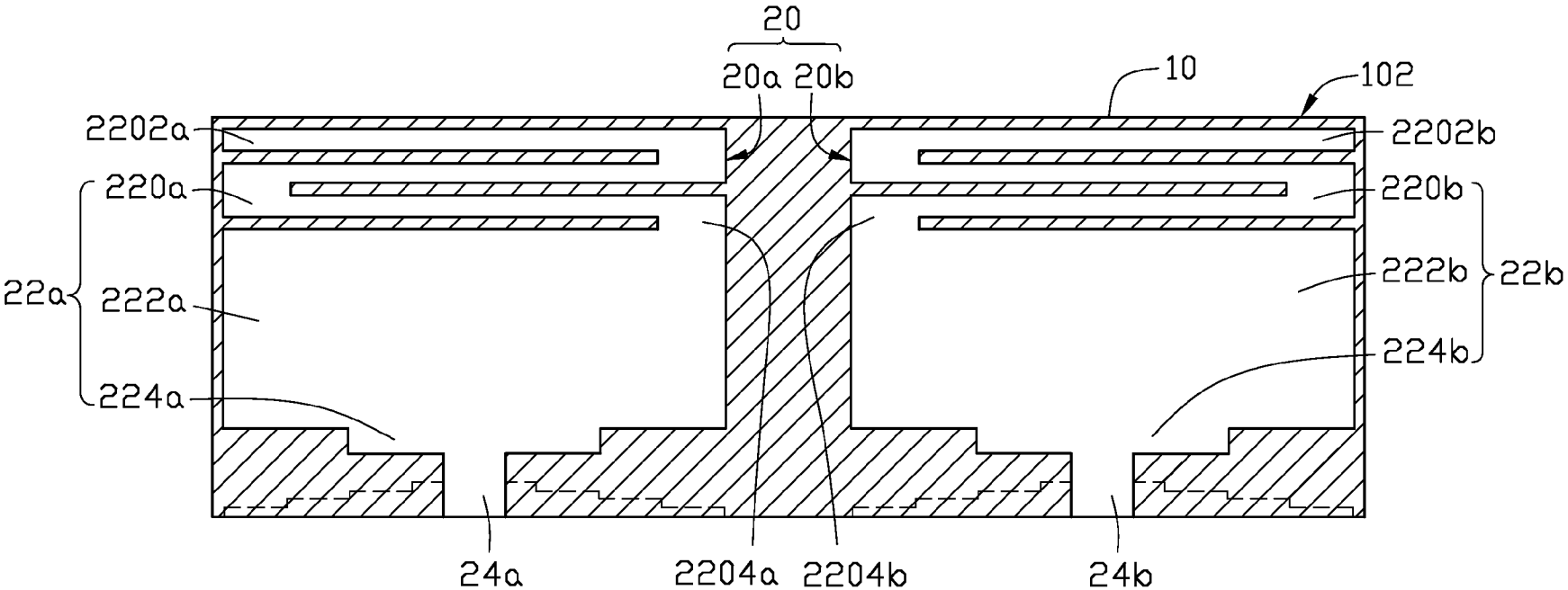
FIG. 1 is a front view schematic diagram of a Multi Input Multi Output (MIMO) antenna in accordance with an embodiment of the invention.
Figure 2:
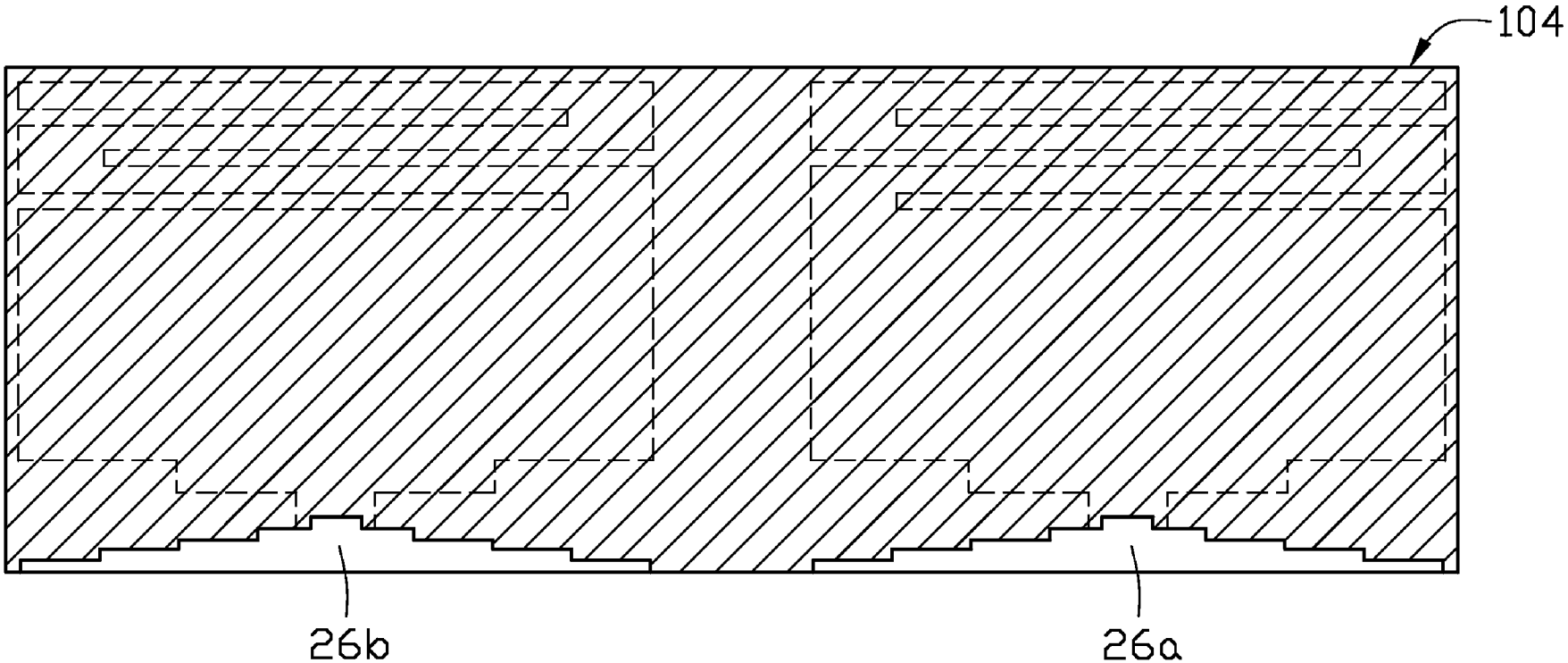
FIG. 2 is a back view schematic diagram of the MIMO antenna of FIG. 1.

FIG. 1 and FIG. 2 are respectively front and back views of a Multi Input Multi Output (MIMO) antenna 20 in accordance with an embodiment of the invention.

In this embodiment, the MIMO antenna 20 is disposed on a substrate 10. The substrate 10 includes a first surface 102 (as shown in FIG. 1) and a second surface 104 (as shown in FIG. 2) opposite to the first surface 102. The MIMO antenna 20 includes at least a first antenna 20*a* and a second antenna 20*b*. The first antenna 20*a* is set as mirror image to the second antenna 20*b*, that is, the first antenna 20*a* and the second antenna 20*b* are in axial symmetry.

The first antenna 20*a* includes a radiation body 22*a*, a feeding portion 24*a*, and a grounded portion 26*a*. The radiation body 22*a* includes a first radiation portion 220*a*, a second radiation portion 222*a*, and a connecting portion 224*a*.

The second antenna 20*b* similarly includes a radiation body 22*b*, a feeding portion 24*b*, and a grounded portion 26*b*. The radiation body 22*b* includes a first radiation portion 220*b*, a second radiation portion 222*b*, and a connecting portion 224*b*.

The radiation bodies 22*a*, 22*b* are disposed on the first surface 102, for transceiving electromagnetic signals. The first radiation portions 220*a*, 220*b* are serpentine-shaped, and each includes an open end 2202*a* (2202*b*) and a connecting end 2204*a* (2204*b*) electronically connected to the second radiation portion 222*a* (222*b*). In this embodiment, the connecting end 2204*a* is disposed adjacent to the connecting end 2204*b*. The open ends 2202*a* and 2202*b* are mirror images of each other and extend in opposite directions. In this way, the isolation between the first antenna 20*a* and the second antenna 20*b* is improved. The connecting portion 224*a* (224*b*) is electronically connected between the second radiation portion 222*a* (222*b*) and the feeding portion 24*a* (24*b*). The feeding portion 24*a* (24*b*) is disposed on the first surface 102, and electronically connected to the second radiation portion 222*a* (222*b*). The feeding portion 24*a* (24*b*) is used for feeding electromagnetic signals to the radiation body 22*a* (22*b*). The grounded portions 26*a*, 26*b* are disposed on the second surface 104.

In this embodiment, the first radiation portion 220*a* (220*b*) can reduce the rectilinear length of the radiation body 22*a* (22*b*) yet still keep the radiation body 22*a* (22*b*) resonating. A radiation field produced by a coupling effect of the first radiation portions 220*a*, 220*b* can improve the radiation efficiency of the MIMO antenna 20. In other words, the first radiation portions 220*a* and 220*b* can reduce the area of the MIMO antenna 20, and improve the radiation efficiency of the MIMO antenna 20. In this embodiment, the first radiation portion 220*a* (220*b*) has a selected one of an s-shaped configuration, a w-shaped configuration, and a u-shaped configuration.

The second radiation portions 222*a*, 222*b* and the connecting portions 224*a*, 224*b* are rectangle-shaped. In this embodiment, a length and a width of the connecting portion 224*a* (224*b*) are smaller than those of the second radiation portion 222*a* (222*b*). The connecting portion 224*a* (224*b*) has matching impedance function.

The grounded portions 26*a*, 26*b* are step-shaped and in axial symmetry along an axis of the first surface 102. In this embodiment, the grounded portions 26*a*, 26*b* can improve the radiation efficiency of the MIMO antenna 20.

Figure 3:
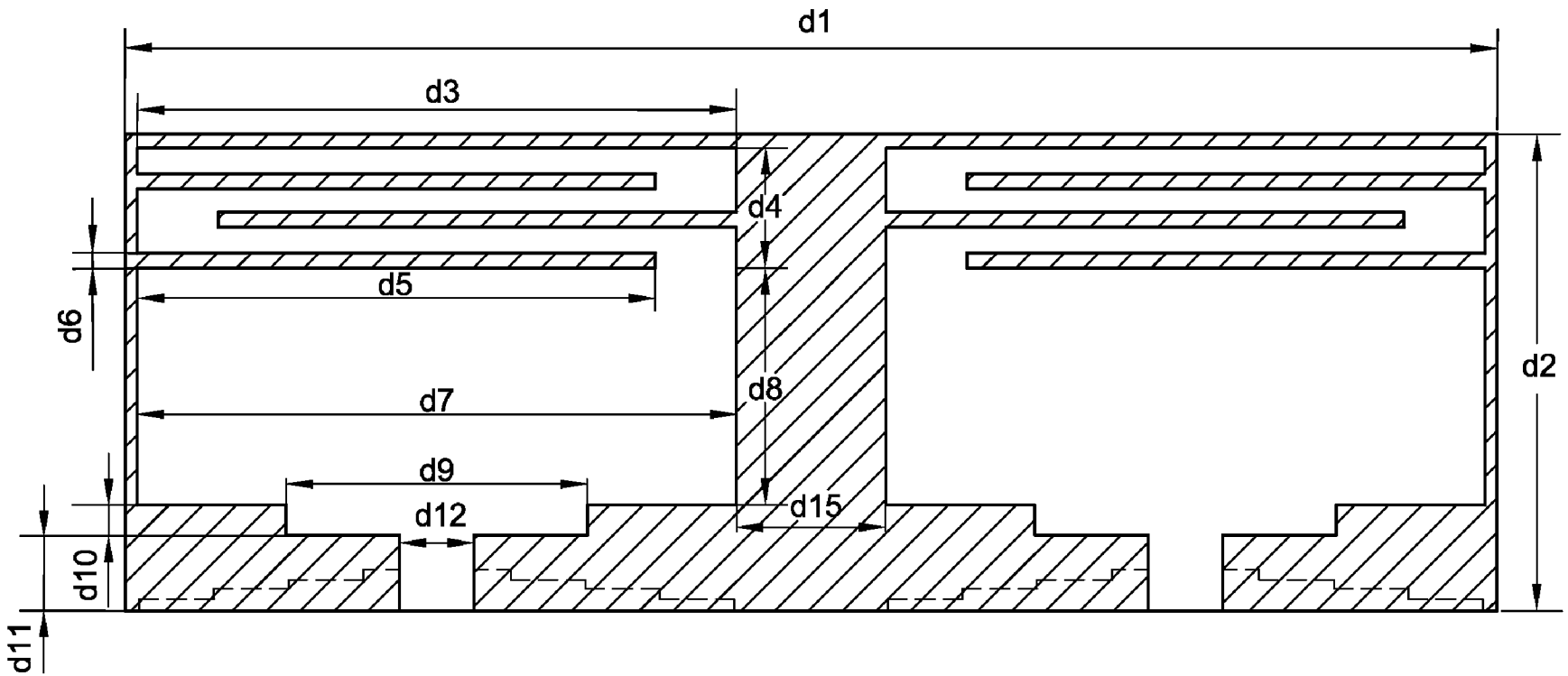
FIG. 3 and FIG. 4 are schematic diagrams illustrating dimensions of the MIMO antenna of FIG. 1 and FIG. 2.
Figure 4:
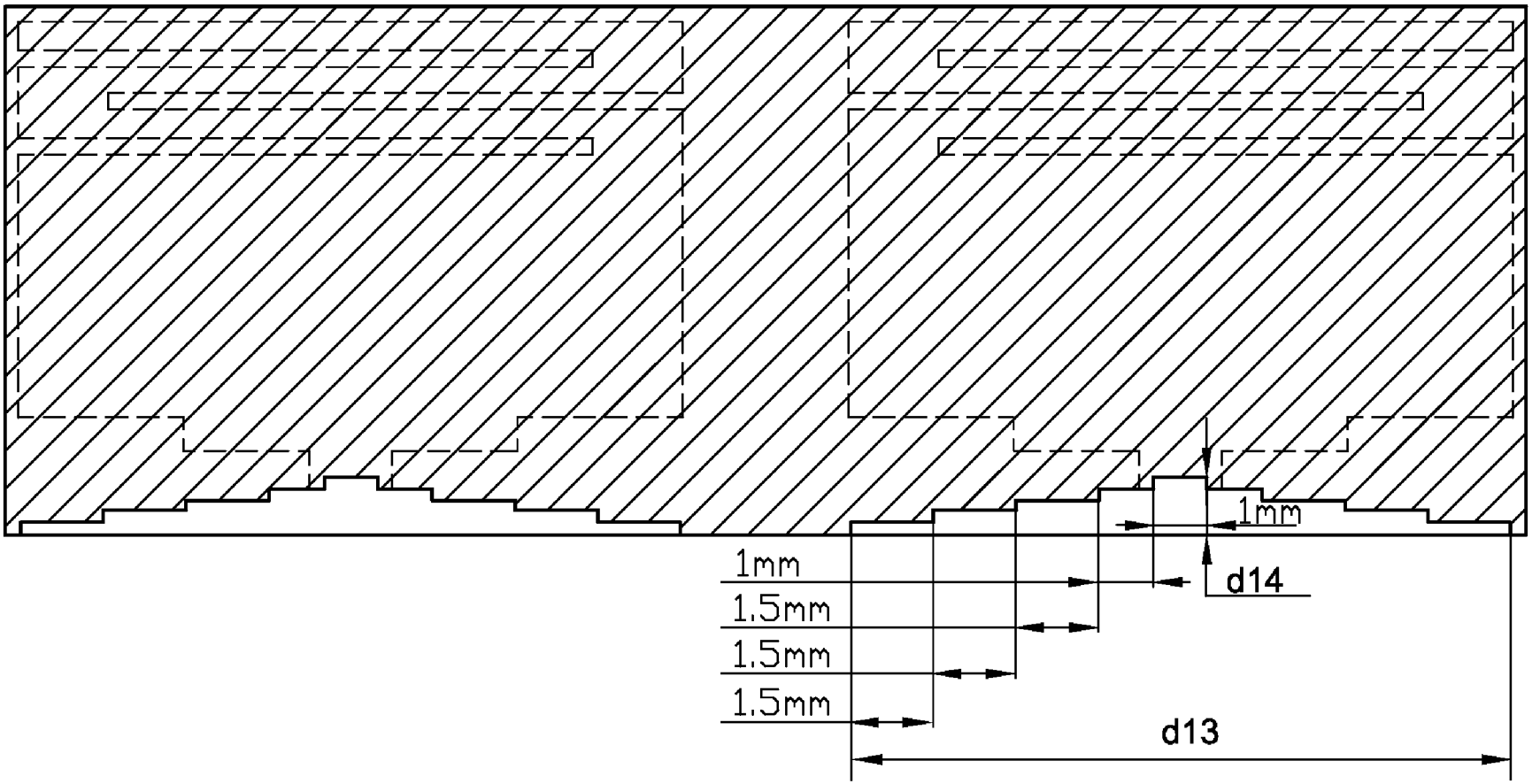

FIG. 3 and FIG. 4 jointly illustrate dimensions of the MIMO antenna 20 of FIG. 1 and FIG. 2.

In this embodiment, a total length d1 of the MIMO antenna 20 is 27.5 millimeter (mm), and a total width d2 of the MIMO antenna 20 is 9.5 mm. All dimensions of all parts of the first antenna 20*a* are the same as those of the second antenna 20*b*. In order to describe succinctly, we just illustrate dimensions of the first antenna 20*a*. The first radiation 220*a* is serpentine-shaped. A total length d3 of the first radiation 220*a* is 12 mm, and a total width d4 of the first radiation 220*a* is 2.4 mm. A length d5 of the slot of the first radiation 220*a* is 10.4 mm, and a width d6 of the slot of the first radiation 220*a* is 0.3 mm. The second radiation portion 222*a*, the connecting portion 224*a*, and the feeding portion 24*a* are rectangle-shaped. A length d7 of the second radiation portion 222*a* is 12 mm, and a width d8 of the second radiation portion 222*a* is 4.725 mm. A length d9 of the connecting portion 224*a* is 6 mm, and a width d10 of the connecting portion 224*a* is 0.5 mm. A length d11 of the feeding portion 24*a* is 1.675 mm, and a width d12 of the feeding portion 224*a* is 1.5 mm. The parallel distance d15 between the first antenna 20*a* and the second antenna 20*b* is 3 mm.

In FIG. 4, a total width d13 of the grounded portion 26*a* is 12 mm, and a total height d14 of the grounded portion 26*a* is 1 mm. The grounded portion 26*a* is step-shaped and symmetrical along an axis, and the projection of the axis on the first surface 102 and the feeding portion 24*a* partially overlap. The grounded portion 26*a* has 5 steps, and a height of each step is about 0.2 mm. Widths of the fourth step and the fifth step are about 1 mm, and widths of the other steps are about 1.5 mm. In other embodiments, the grounded portion 26*a* may be other shaped so long as the overall dimensions remain at about 1 mm high by about 12 mm wide.

Figure 5:
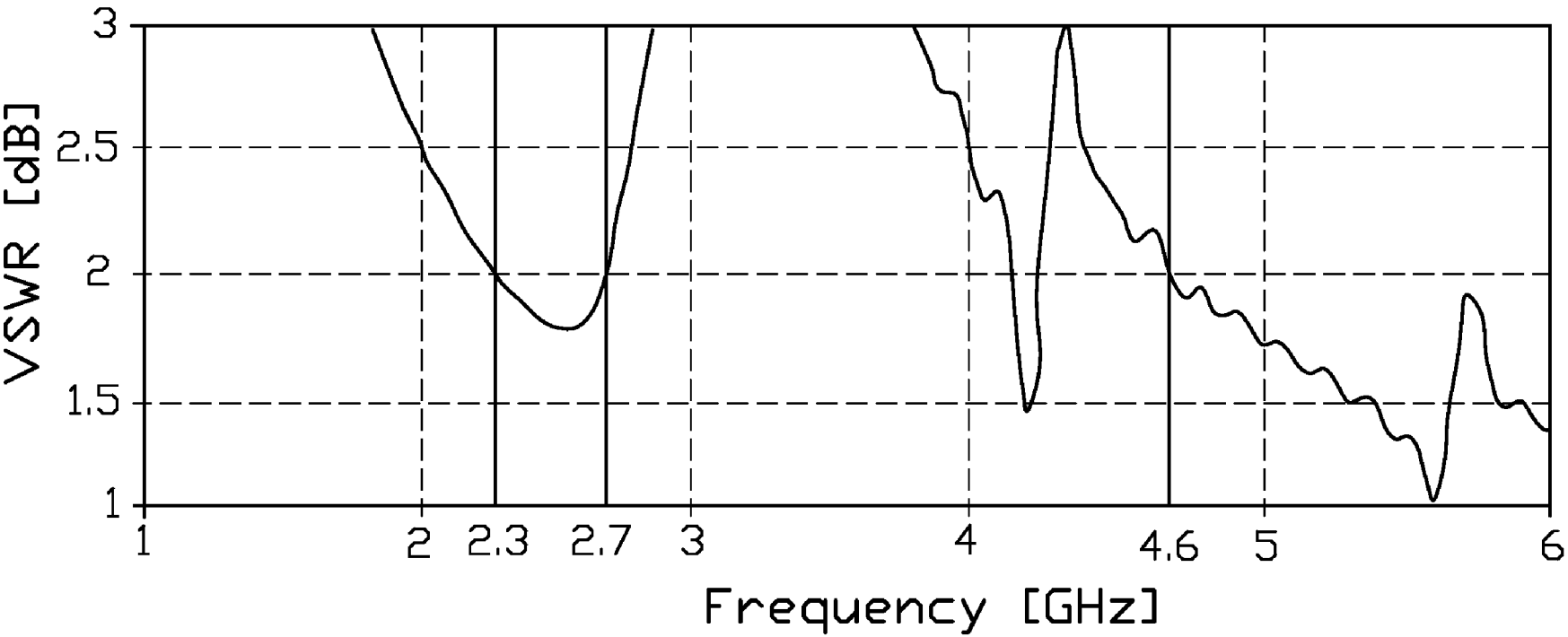
FIG. 5 is a graph of test results showing voltage standing wave ratios (VSWRs) of a first antenna of the MIMO antenna of FIG. 1.

FIG. 5 is a graph of test results showing voltage standing wave ratios (VSWRs) of the first antenna 20*a* of the MIMO antenna 20 of FIG. 1. The horizontal axis represents the frequency (in GHz) of the electromagnetic signals traveling through the first antenna 20*a*, and the vertical axis represents amplitude of the VSWRs. A curve shows the amplitude of the VSWRs of the first antenna 20*a* at operating frequencies. As shown in FIG. 5, the first antenna 20*a* performs well when operating at frequency bands of 2.3-2.7 GHz and 4.6-6.0 GHz. The amplitude values of the VSWRs in the band pass frequency range are smaller than a value of 2, indicating the first antenna 20*a* complies with application requirements of the MIMO antenna 20.

Figure 6:
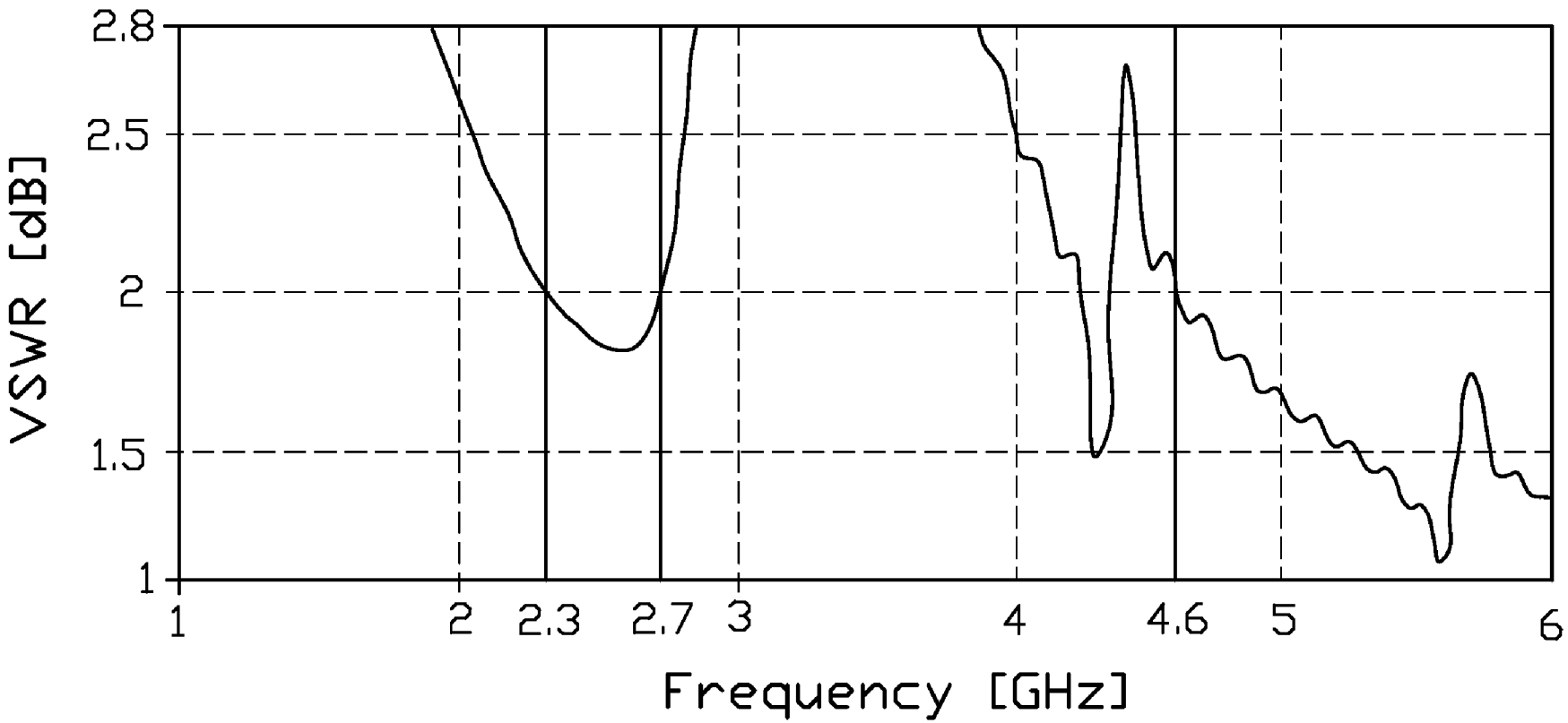
FIG. 6 is a graph of test results showing the VSWRs of a second antenna of the MIMO antenna of FIG. 1.

FIG. 6 is a graph of test results showing VSWRs of the second antenna 20*b* of the MIMO antenna 20 of FIG. 1. The horizontal axis represents the frequency (in GHz) of the electromagnetic signals traveling through the second antenna 20*b*, and the vertical axis represents amplitude of the VSWRs. A curve shows the amplitude of the VSWRs of the second antenna 20*b* at operating frequencies. As shown in FIG. 6, the second antenna 20*b* performs well when operating at frequency bands of 2.3-2.7 GHz and 4.6-6.0 GHz. The amplitude values of the VSWRs in the band pass frequency range are smaller than a value of 2, indicating the second antenna 20*b* complies with application requirement of the MIMO antenna 20.

Figure 7:
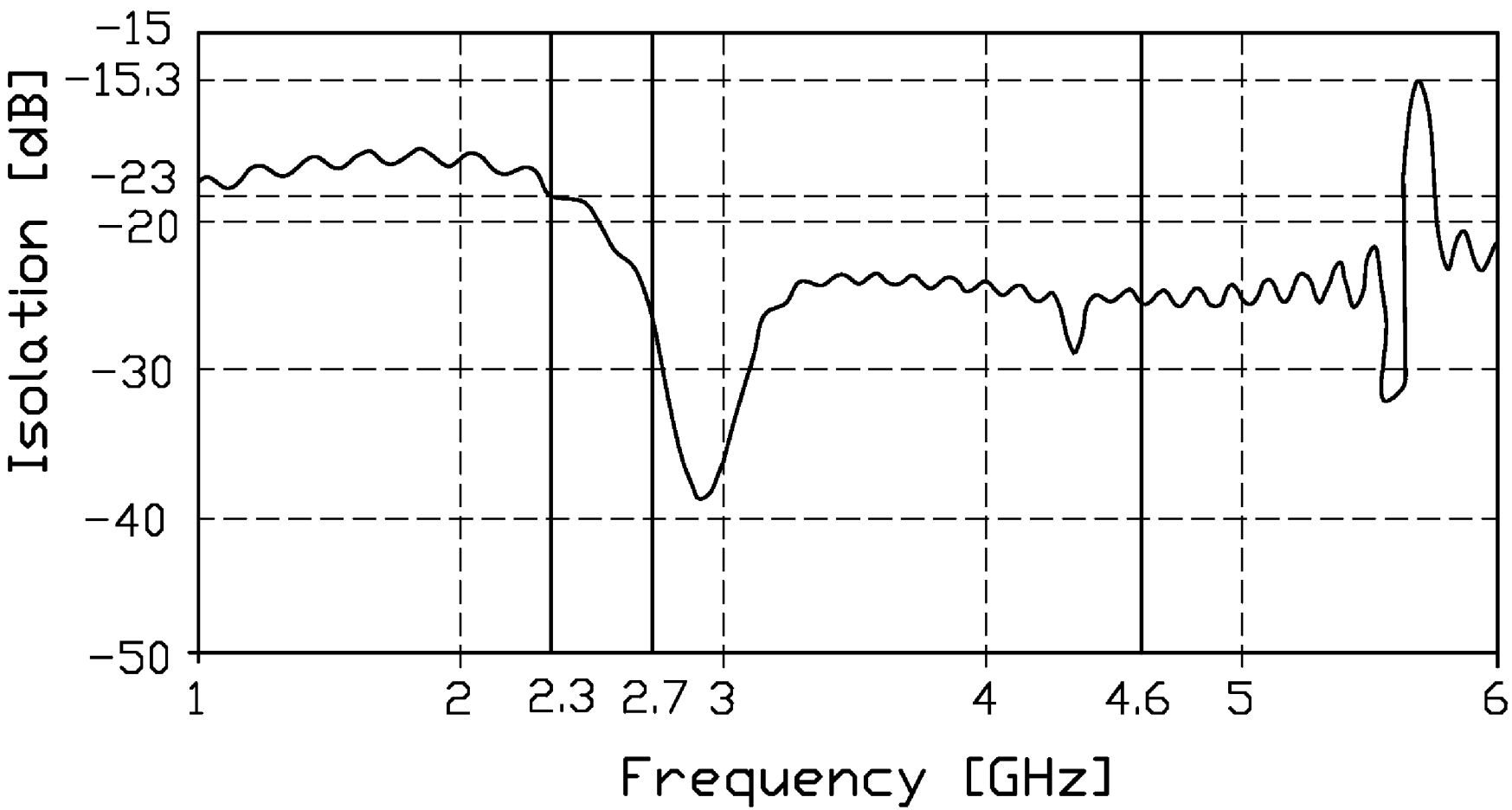
FIG. 7 is a graph of test results showing isolation between the first antenna and the second antenna of the MIMO antenna of FIG. 1.

FIG. 7 is a graph of test results showing isolation between the first antenna 20*a* and the second antenna 20*b* of the MIMO antenna 20 of FIG. 1. The horizontal axis represents the frequency (in GHz) of the electromagnetic signals traveling through the MIMO antenna 20, and the vertical axis represents the amplitude of the isolation. As shown in FIG. 7, a curve shows isolation between the first antenna 20*a* and the second antenna 20*b* is at most substantially −23 dB when the MIMO antenna 20 operates at frequency band of 2.3-2.7 GHz. Isolation between the first antenna 20*a* and the second antenna 20*b* is at most substantially −15.3 dB when the MIMO antenna 20 operates at frequency band of 4.6-6.0 GHz. The isolation values of the two bands are smaller than −10, indicating the MIMO antenna 20 complies with application requirement of a MIMO antenna.

In this embodiment, the first radiation portion 220*a* (220*b*) is serpentine-shaped. Therefore, the area of the MIMO antenna 20 is reduced. The grounded portion 26*a* (26*b*) improves the VSWRs of the MIMO antenna 20 operating at the pass bands.

What is claimed is:

1. A Multi Input Multi Output (MIMO) antenna, disposed on a substrate comprising a first surface and a second surface, the MIMO antenna comprising a first antenna and a second antenna set as mirror image to the first antenna, each of the first and the second antennas comprising:

a radiation body, disposed on the first surface, for transceiving electromagnetic signals, the radiation body comprising a first radiation portion and a second radiation portion electronically connected to the first radiation portion, the first radiation portion being serpentine-shaped, the second radiation portion being rectangular-shaped;

a feeding portion, disposed on the first surface, and electronically connected to the second radiation portion, for feeding electromagnetic signals to the radiation body; and a grounded portion, disposed on the second surface, the grounded portion being step-shaped and symmetrical along an axis of the first surface.

2. The MIMO antenna as recited in claim 1, further comprising a connecting portion electronically connected between the second radiation portion and the feeding portion.

3. The MIMO antenna as recited in claim 2, wherein the connecting portion is rectangle-shaped.

4. The MIMO antenna as recited in claim 3, wherein a width and a length of the connecting portion are smaller than those of the second radiation portion.

5. The MIMO antenna as recited in claim 1, wherein the first radiation portion has a selective one of an s-shaped configuration, a w-shaped configuration, and a u-shaped configuration.

6. The MIMO antenna as recited in claim 5, wherein the first radiation portion comprises an open end and a connecting end electronically connected to the second radiation portion.

7. The MIMO antenna as recited in claim 6, wherein the connecting end of the first antenna is disposed adjacent to the connecting end of the second antenna.

8. The MIMO antenna as recited in claim 7, wherein the open end of the first antenna and the open end of the second antenna are mirror images of each other and extends in opposite directions.

9. A Multi Input Multi Output (MIMO) antenna disposed on a substrate comprising at least two surfaces, the MIMO antenna comprising at least two individual antennas, each of the individual antennas comprising:

a radiation body, disposed on one of the surfaces for radiating electromagnetic signals, the radiation body comprising a first radiation portion and a second radiation portion electronically connected to the first radiation portion, the first radiation portion being serpentine-shaped, the second radiation portion being rectangular-shaped;

a feeding portion, disposed on the same surface as the radiation body, and electronically connected to the second radiation portion, for feeding electromagnetic signals to the radiation body; and a grounded portion, disposed on the other surface of the substrate, the grounded portion being step-shaped;

wherein the at least two individual antennas are in axial symmetry.

10. The MIMO antenna as recited in claim 9, wherein the first radiation portion comprises an open end, and a connecting end electronically connected to the second radiation portion.

11. The MIMO antenna as recited in claim 10, wherein the open ends of the at least two antennas extend in opposite direction.

12. The MIMO antenna as recited in claim 9, wherein the first radiation portion is in an s-shape, a w-shape, or a u-shape.

13. A Multi Input Multi Output (MIMO) antenna assembly, comprising a substrate comprising two opposite surfaces; and at least two individual antennas formed side by side along said two opposite surfaces of said substrate, each of said at least two individual antennas comprising a radiation body formed on one of said two opposite surfaces for radiating electromagnetic signals, and a grounded portion formed on the other of said two opposite surfaces, said radiation body comprising a serpentine-shaped radiation portion formed at one end thereof, and a feeding portion for feeding electromagnetic signals to said radiation body electrically connectable with the other end of said radiation body opposite to said one end of said radiation body having said serpentine-shaped radiation portion, said serpentine-shaped radiation portion of one of said at least two individual antennas being symmetrically formed to said serpentine-shaped radiation portion of another of said at least two individual antennas neighboring said one of said at least two individual antennas along said one of said two opposite surfaces, wherein said grounded portions of said at least two individual antennas are step-shaped, and said grounded portion of said one of said at least two individual antennas is symmetrically formed to said grounded portion of said another of said at least two individual antennas.

14. The MIMO antenna assembly as recited in claim 13, wherein a rectangular-shaped radiation portion is formed in said radiation body and is electrically connectable between said serpentine-shaped radiation portion of said radiation body and said feeding portion.

* * * * *